US007836635B2

(12) United States Patent
Webb

(10) Patent No.: US 7,836,635 B2
(45) Date of Patent: Nov. 23, 2010

(54) DOOR SAFETY DEVICE

(76) Inventor: Stephen Robert Webb, 385 Chepstow Avenue, Hornchurch, Essex RM12 6AU (GB)

( * ) Notice: Subject to any disclaimer, the term of this patent is extended or adjusted under 35 U.S.C. 154(b) by 670 days.

(21) Appl. No.: 10/522,673

(22) PCT Filed: Jul. 30, 2003

(86) PCT No.: PCT/GB03/03211

§ 371 (c)(1),
(2), (4) Date: Dec. 5, 2005

(87) PCT Pub. No.: WO2004/011758

PCT Pub. Date: Feb. 5, 2004

(65) Prior Publication Data

US 2006/0101617 A1 May 18, 2006

(30) Foreign Application Priority Data

Jul. 30, 2002 (GB) ..... 0217580.0

(51) Int. Cl.
*E05D 5/14* (2006.01)

(52) U.S. Cl. ..... 49/384

(58) Field of Classification Search ..... 49/383, 49/384; 160/40–42
See application file for complete search history.

(56) References Cited

U.S. PATENT DOCUMENTS

| | | | | |
|---|---|---|---|---|
| 6,931,789 | B2 * | 8/2005 | Stout, Jr. | 49/383 |
| 2002/0046501 | A1 * | 4/2002 | Webb | 49/502 |
| 2004/0098916 | A1 * | 5/2004 | Albenda | 49/383 |

FOREIGN PATENT DOCUMENTS

| | | | |
|---|---|---|---|
| FR | 2726317 | A1 | 5/1996 |

* cited by examiner

*Primary Examiner*—Jerry Redman
(74) *Attorney, Agent, or Firm*—Banner & Witcoff, Ltd.

(57) ABSTRACT

When a door is open, at a hinge side of the space between the door and door frame a gap appears and this presents an opening into which a young child's hand or fingers can very easily be inserted. The invention provides a cover for this space which can help to reduce risk of injury if the door should be closed accidentally when a child's hand is present. A door safety device comprises a cover for the gap at the hinge side of a door (2) and door frame (4) combination, the cover comprising a strip of a rigid material which is flexible about its major axis, the strip having attachment means at its long edges so that one edge may be secured to the door (2) and the other edge to the door frame (4) of the combination, and the cover including fastener means (13) adjacent to one of its long sides such that the cover may be secured to a second similar cover in order to increase the effective width of the safety device. This can enable a single model of safety device to be adapted to fit ordinary domestic doors and also doors which open through wider angles such as up to 180°.

16 Claims, 4 Drawing Sheets

DOOR SAFETY DEVICE

Benefit of the International Filing Date of Jul. 30, 2003, of PCT/GB2003/003211 and benefit of the Jul. 30, 2002 filing date of GB 0217580.0, both by the same inventor and both entitled "Door Safety Device" are claimed.

BACKGROUND

This invention relates to a door safety device. It relates particularly to a device for fitting at the hinge side of a door and door frame in order to reduce the risk of injury to a child's fingers if they should attempt to enter this space.

When a door is in the open position, the hinge side of the opening between the door side and the door frame offers a gap into which a young child's hand or fingers can very easily be inserted If the door should then be closed, possibly by another child or by the pressure from a draught of wind, there is a serious risk that the hand or fingers will become hurt or badly damaged. In time, of course, any child will learn that the gap at the edge of a door that is being closed is a dangerous area in the home and any fingers should be kept well away from this zone. However, the younger child will not be aware of this risk and may suffer a crushed finger.

There have been attempts already to overcome this problem and patent No. GB2306538 discloses a shield device for fixing at the hinge side of a door and door frame combination. This device is effective for doors of the standard hinged kind as well as doors with the rising butt type of hinges and doors mounted on pivot hinges. The construction described is effective for most domestic doors since these usually open through an angle of 90° or possibly up to 140°. There is, however, additionally a need to provide a door safety device which will be effective on doors which open through a wider angle such as up to 180°.

I have now devised a door safety device which is intended to provide a single shield effective to protect both types of doors, those opening up to 140° and those opening beyond this angle.

SUMMARY

According to the invention, there is provided a door safety device comprising a cover for the gap at the hinge side of a door and door frame combination, the cover comprising a strip of rigid material which is flexible about its major axis, the strip having attachment means at its long edges so that one edge may be secured to the door and the other edge to the door frame of the combination, and the cover including fastener means adjacent one of its long sides such that the cover may be secured to a second similar cover in order to increase the effective width of the safety device. The fastener means may be a clip fitting. This clip fitting can allow a single unit of the device to be used on an ordinary door gap but the single unit may be clipped to a second similar unit if it is required for the device to be used on a door where the presence of a large gap may be expected.

The clip fitting may be a continuous clip which extends the whole length of the strip. Alternatively, the clip fitting may be a fixture which is present at intervals along the length of the strip. The fixing effect of the clip fitting may be supplemented by the inclusion of a strip of adhesive material which is covered by a removable protective film until it is required to be used.

Preferably, the safety device also includes an attachment means for securing the device to one of the door or door frame of the combination, which means will allow the device to be moved vertically with respect to the attachment means so that the device will also be fully effective when used on a door having rising butt hinges.

By way of example, a particular embodiment of the invention will now be described with reference to the accompanying drawings, in which:

DETAILED DESCRIPTION

Figure 1:
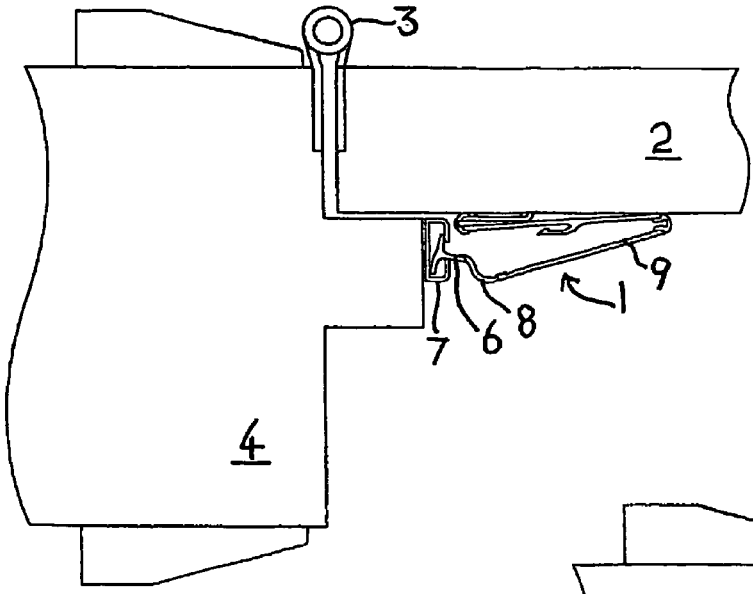
FIG. 1 is a cross-sectional view of the safety device when fitted to a door and door frame combination.

As shown in FIG. 1, the safety device 1 has been fitted to a door 2 which is attached by a hinge 3 to a door frame 4. The view depicted is a partial cross-sectional view with only the significant parts of the construction being shown The safety device 1 comprises a rigid plastics T-section member 6 which is freely supported in a C-shaped channel section 7. The member 6 is linked by a soft plastics joint 8 to a first strip 9 which in turn is linked by another joint to a second strip and this is coupled by a further joint to a support member.

The use of the T-section member 6 carried in the channel section 7 provides a floating anchor effect which gives a low friction support whilst still permitting any necessary lengthwise movement along the section 7.

Figure 2:
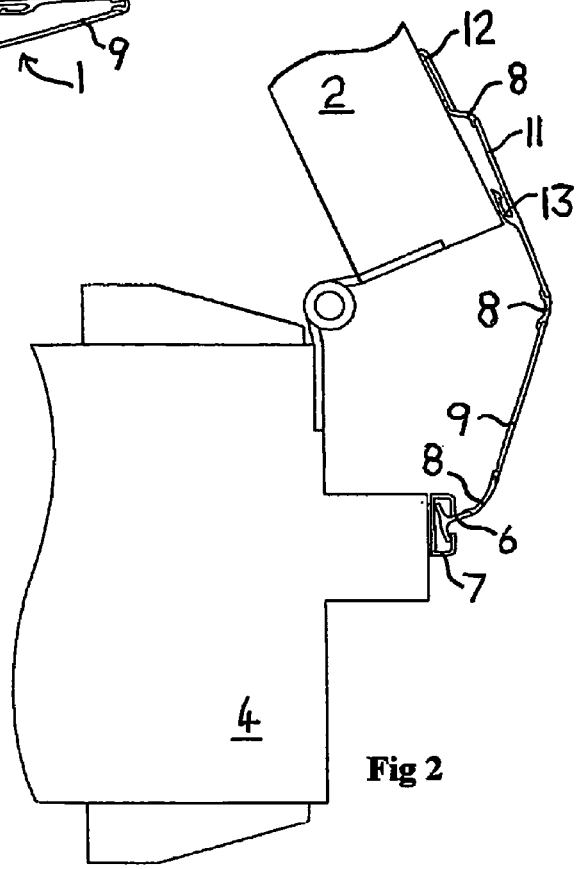
FIG. 2 is a similar view showing the safety device when the door is in the open condition.

FIG. 2 shows the safety device when the door 2 has been moved to the open condition. The first strip 9 is seen to be linked to the second joint 8 and this is attached to the second strip 11 which is coupled by the third joint 8 to the support member 12. The support member 12 is shown secured to the surface of the door 2 by an adhesive pad. The channel section 7 is similarly secured to the door frame 4 by an adhesive pad. The channel section 7 serves to support the T-section member 6 in a secure but light grip. This grip enables the member 6 to slide up and down in the section 7 if such a movement will be necessary in order to follow the action of a rising butt hinge should such a hinge be in use on the door. The presence of the member 6 and section 7 thus enables the safety device to be used on a door with either the standard or the ring butt type of hinge.

In the FIG. 2 view, the movement of the door from its closed position is slightly more than an angle of 90° and the first strip 9 and second strip 11 of the safety device are seen to have opened out to form a convex cover over the gap between the door edge and the door frame. A buffer 13 on the second strip 11 has come to rest against the corner surface of the door and this acts to hold the second strip 11 away from the door edge so that the convex shape is firmly defined. The ordinary pressure of a hand on the strip 11 will not cause the convex shape to be depressed and thus it will resist any attempt by a child's hand to enter this gap.

When the door 2 is closed again, the safety device becomes folded neatly so that it will come to rest in the attitude depicted in FIG. 1. There is little chance for a hand to become trapped during the closing process because the plastics materials of the device remain pliable and they are only able to grip in a soft manner.

The complete safety device was able to be constructed of plastics materials in a plastics extrusion process where the rigid and flexible parts were formed together by a coextrusion technique. The channel section 7 was of course a separately extruded part.

Figure 3:
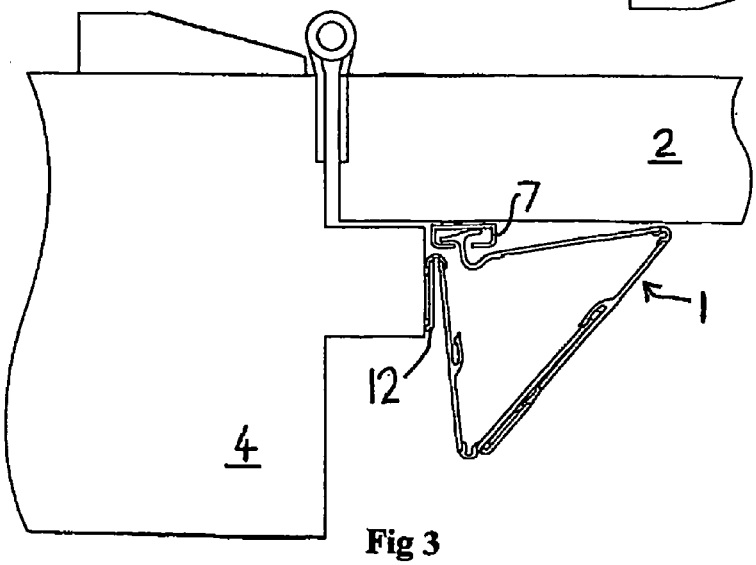
FIG. 3 is a similar view of the device having been modified to form a double unit.

FIG. 3 is a view similar to FIG. 1 and it will be noted that in FIG. 3 the mounting of the safety device 1 has been reversed as compared to FIG. 1 with the section 7 being attached to the door 2 and the support member 12 being attached to the door frame 4. This is an alternative mounting arrangement which may be used, for example, when the door frame has the same width as that of the folded safety device.

The FIG. 3 view shows the effect of two of the safety devices 1 being coupled together to form a double unit The assembly is seen to be larger than that of FIG. 1 but there are no dangerous gaps present that might form traps for a child's fingers. The method of joining two of the safety devices 1 to form a double unit will be described later.

Figure 4:
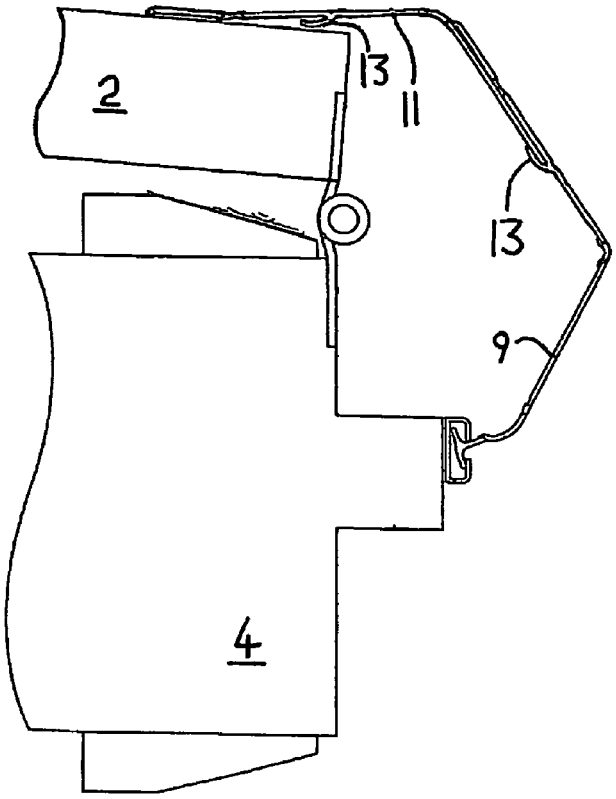
FIG. 4 shows the double unit device when the door has been opened to an angle of some 180°.

FIG. 4 shows the effect of the door being opened out to an angle of almost 180° using the mounting arrangement of FIG. 1 and the double unit safety device combination of FIG. 3. The buffer 13 on the second strip 11 has again served to hold the strip out from the door edge in a convex shape that will resist any inward pressure. The greater width of the device that was obtained by converting the single safety device into a double unit has allowed the door to be opened to its full extent.

Figure 5:
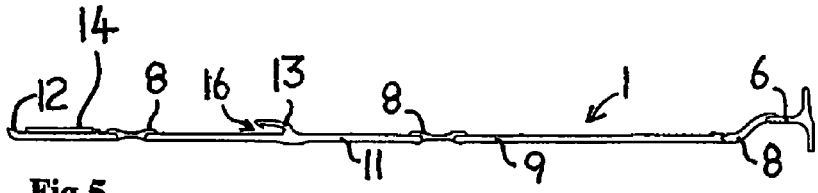
FIG. 5 is a cross-sectional view of the safety device on its own.

FIG. 5 shows the safety device on its own. The T-section member 6 is attached by the joint 8 to the first strip 9 and this is connected by the further joint 8 to the second strip 11. The second strip 11 carries the buffer 13 and this strip is then connected by its joint 8 to the support member 12. The support member 12 carries its own adhesive pad 14.

Figure 6:
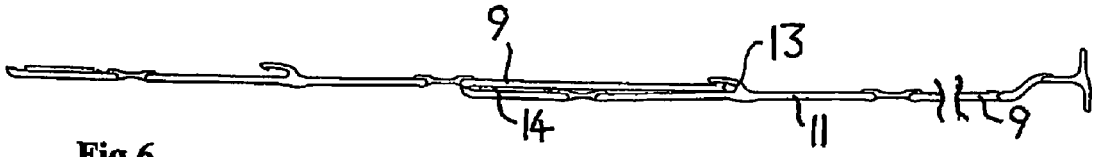
FIG. 6 is a similar view of two safety devices secured together to form a double unit.

In order to form a double unit safety device as depicted in FIG. 6, two equal portions of the safety device extruded length are taken and on one of these portions the member 6 is cut off by the use of a knife through the soft material of the joint 8 adjacent the member 6. The cut member 6 is then discarded. At this stage, it will be noticed that the buffer 13 which forms part of the second strip 11 is shaped like a short arm which is tilted to one side to define a socket 16 shape. In fact, the buffer 13 additionally terminates in an inwardly turned tooth formation which can serve for retaining an object in this socket 16.

The cut end of the said first strip 9 is then pushed into the socket 16 of the buffer 13 on the second portion of the device. The adhesive pad 14 on the portion which has been cut is then activated by removing its protective film and the two strips 9,11 are pressed into contact to create a permanent bond between them.

The FIG. 6 view shows that the original length of the safety device 1 has been thereby extended by some 56% so that this double unit assembly will be particularly suitable for use on door arrangements where a wide opening gap might be formed.

The double unit safety device can then be used on doors which open to a wider than usual angle. The fat that the double unit construction can be achieved so easily and quickly means that it is not necessary to keep in stock a special device for wider opening doors since the standard safety device can be used for both types of door opening. Since only perhaps one in ten doors is designed to open to an angle of 140° to 180° this means that only the single unit safety device is needed to be kept in stock and then this model can be adapted to form the double unit device whenever this is necessary for a particular job. The double unit device does, of course, retain the benefit of being equally useful on doors with standard or rising butt hinges. It is also suitable for doors which are mounted on pivots instead of hinges.

Figure 7:
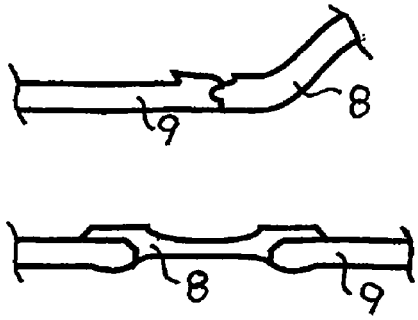
FIG. 7 is a detail of a flexible joint part of the safety device.

FIG. 7 shows two embodiments of joint structure by which the rigid members of the safety device 1 are attached to the lengths of the joint 8 material. As shown in the Figure, the joints are not plain joints but they are designed to have an increased surface area of contact between the two mate so that there will be a greater overlap and consequently an enhanced strength of the bond The overlap of the joint 8 material may even be extended along the surface of the rigid material 9 so that a substantial area of contact will be used. This is shown in the lower one of the FIG. 7 views. The provision of a strong attachment between the rigid members and the joint 8 material is useful in resisting damage to the safety device that might be caused by normal heavy usage or by vandalism. By having a comparatively long length of the joint 8 material between the rigid members, this avoids the need to have a sharp bend at any point along the length of the joint 8 and thus reduces any stresses which may occur. The length of the joint 8 also allows a movement of the second strip 11 out of the plane of the support member 12 so that the safety device can adapt more easily to the stresses caused by the need to cover over a wider angle door opening. An example of this adaptation is seen in the upper part of FIG. 2.

Figure 8:
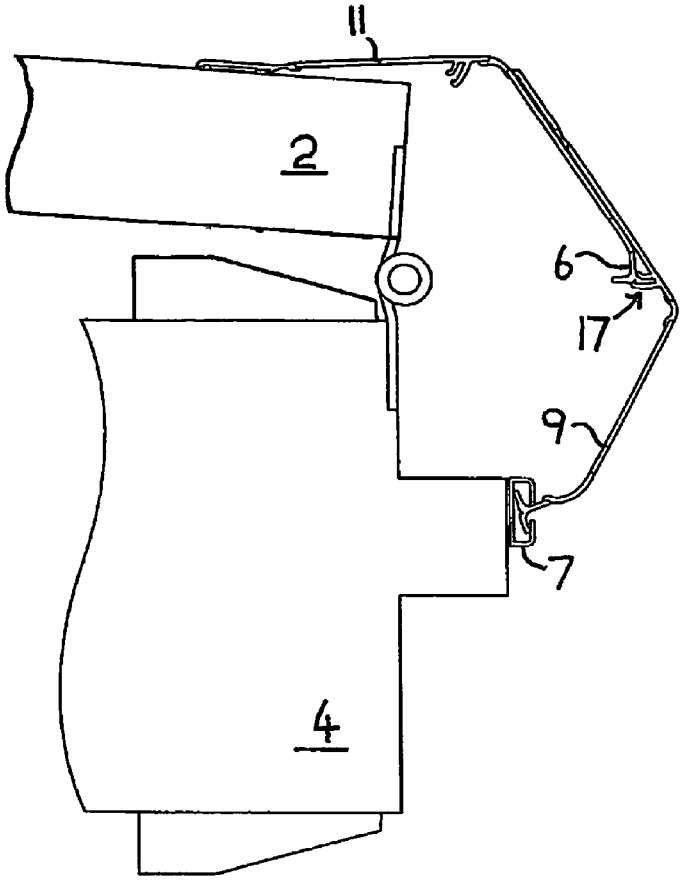
FIG. 8 shows an alternative construction of safety device for forming a double unit.

FIG. 8 shows an alternative construction of safety device for forming the double unit In this embodiment, it is not necessary to remove the member 6 by a cutting operation and this member is able to be used by securing it in an opening formed between two lips 17 located on the strip 11.

Figure 9:
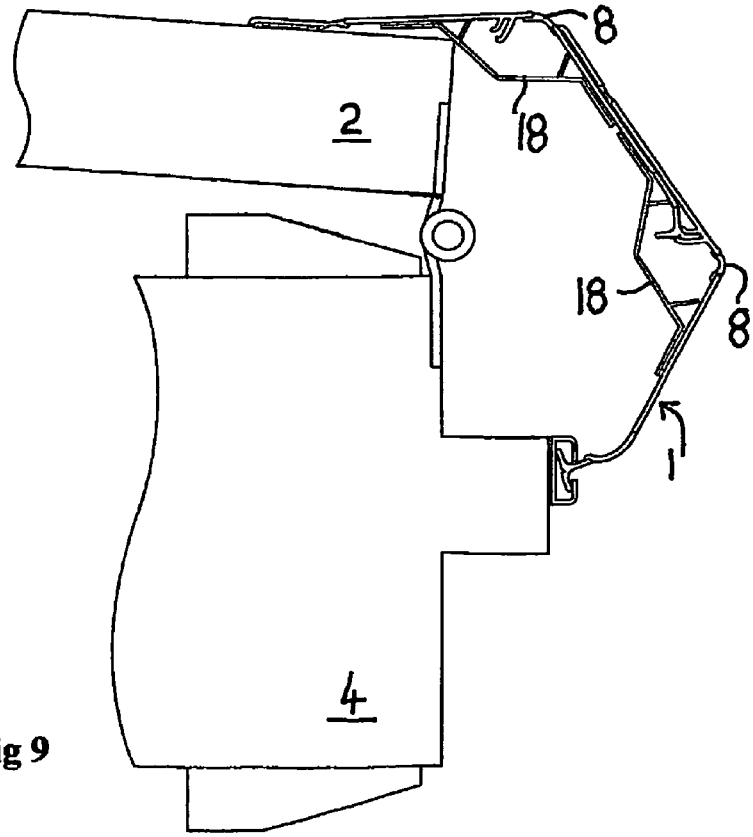
FIG. 9 shows the device of FIG. 8 where an angle support accessory has been fitted.

FIG. 9 is similar to FIG. 8, however, this shows that an angle support accessory 18 has been fitted behind two of the joint 8 portions of the device 1. The purpose of the accessory 18 is to prevent either of the joint 8 portions which are normally of a convex shape from being forced into a concave attitude by accident or by misuse of the safety device. The misuse might occur if a user of the safety device tried to push one of the joint 8 portions inwardly. The accessory 18 thus serves to support the joint portion and prevent it from becoming distorted in shape.

Figure 10:
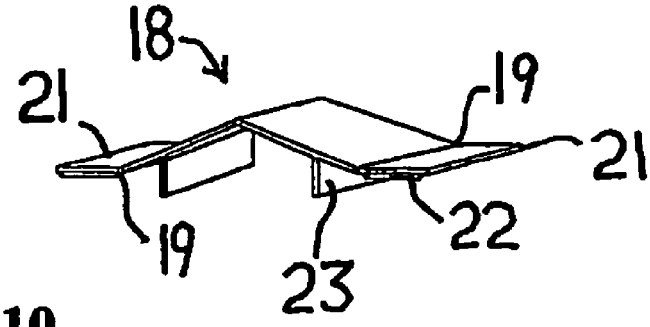
FIG. 10 depicts the angle support accessory on its own, and, FIG. 11 shows on a reduced scale a view of a door and door frame with the safety device fitted in place.

FIG. 10 shows the angle support accessory 18 on its own. This is seen to be a generally W-shaped plastics moulding having two hinges 19 and end portions 21 carrying self-adhesive pads 22. A rigid central area of the accessory 18 is provided with two distance pieces 23.

The accessory 18 is able to be fitted in pieces of short length along the length of each joint 8 portion of the door safety device. If required, the accessory 18 could alternatively be fitted in a single piece along the full length of each joint 8 portion. The accessory 18 is able to be secured very easily to the material of the safety device by the use of the self-adhesive pads 22. It then serves to hold any of the joint 8 portions so that the portion will retain a convex shape externally and thus resist an attempt to distort the shape of the safety device.

Figure 11:
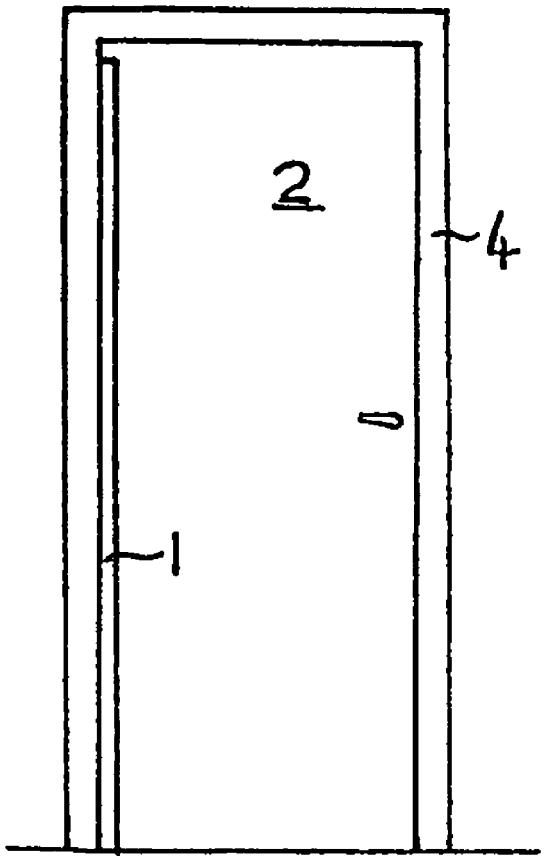

FIG. 11 shows a door 2 located in a door frame 4 with the safety device 1 of the invention mounted at the hinge side of the door 2. The safety device 1 is designed to fold automatically upon closure of the door so that it can remain unobtrusive in appearance.

The safety device of the invention has been found to be able to be manufactured at a comparatively low cost by a plastics extrusion method and this can enable the soft parts forming the joint material to be produced simultaneously with the rigid parts in a coextrusion process. A PVC composition has been found to be suitable for the mouldings. The device makes a minimum use of the raw material in its manufacture. The operation of fitting the device to a door is particularly easy since the C-shaped channel section 7 is secured by an adhesive strip and the support member 12 is similarly attached in place. The T-section member 6 can then be inserted in the section 7 by use of a blunt knife blade and this may be slid lengthwise along the section 7 to complete the fixing of the two parts together. The parts may be dismantled equally easily if this action should ever be necessary. If the safety device when fitted to a door and door frame should be exposed to a vandalism attack, the T-section member 6 is designed to pull out fairly easily from the C-section 7. This action is likely to prevent further damage to the safety device and the T-section member 6 can be easily reinserted in the C-section 7 by use of the blunt knife blade. An ordinary table knife can be used for this purpose.

Whilst the safety device of FIGS. 1 and 2 relies on making use of the door edge to maintain the device in a convex shape when the door is open, the double unit device of FIGS. 3 and 4 is not able to make full use of this property. Accordingly, the double unit relies on a material memory effect to help it maintain a convex shape. In order to activate this effect, after the double unit has been installed on a door, the door is left closed for a period of ten minutes depending upon the relevant room temperature and this allows the flexible sections to pick up a memory of the folded position. The convex shape will then be retained when the door is opened to the FIG. 4 position.

However, in normal use, if part of the safety device should be pushed inadvertently into a concave attitude, the parts of the device above and below the pushed area will return the whole length of the device to its normal convex condition. Even if part of the safety device should be inadvertently pushed inwards as the door is closed, the material memory will generally keep a child's hands from danger by maintaining the convex shape of the device.

The foregoing description of embodiments of the invention has been given by way of example only and a number of modifications may be made without departing from the scope of the invention as defined in the appended claims. For instance, the fixings of the safety device to the door or frame could be done effectively by screw fixings instead of the adhesive bonding method that has been specifically described.

The invention claimed is:

1. A cover for a hinge side of a door, the cover comprising: a first and a second strip of a rigid material connected by a first joint such that the cover is flexible about its major axis, the first strip having a T-section member linked by a second joint to its long edge, the T-section member for being supported in a C-shaped channel section such that the T-section member may move longitudinally with respect to the C-shaped channel, and the second strip having a support member linked by a third joint adjacent to its long edge so that the edge of the cover may be secured to the door or a door frame, and wherein the second strip includes a fastening member disposed between the first joint and the third joint, wherein the fastening member extends from a surface of a second strip thereby defining a structure configured to receive and hold a third strip of material therein.

2. The cover of claim 1, in which the fastening member comprises one or more clip fittings.

3. The cover of claim 1, in which the fastening member further includes a strip of adhesive material disposed therein.

4. The cover of claim 1, in which the cover is formed of four rigid portions connected by three hinges.

5. The cover of claim 1, in which the cover is formed of a fibrous or fluted board material.

6. The cover of claim 1, in which the cover is shaped from a plastic material with the first, second, and third joints being formed integrally.

7. The cover of claim 1, wherein the fastening member is configured to receive a T-section member of the third strip.

8. The cover of claim 1, wherein the fastening member contacts the door and provides support for the second strip such that the cover remains in a convex shape during use.

9. A cover assembly for a hinge side of a door comprising:

a first cover and a second cover, the first cover and second cover each including, a first and a second strip of a rigid material connected by a first joint, the first strip having a T-section member linked by a second joint to its long edge, the second strip having a support member linked by a third joint to its long edge and a socket member, wherein the first strip of the second cover engages with the socket member of the first cover to form a single cover assembly and the T-section member of the first cover is configured to engage a C-shaped channel section attached to a door frame and the support member of the second cover is configured to attach to a door.

10. The cover assembly of claim 9, wherein the socket member of the second cover is configured to abut the door and to support the second cover such that the cover assembly forms a convex shape.

11. The cover assembly of claim 9, wherein at least one angle support is attached to a back side of the assembly.

12. The cover assembly of claim 11, wherein the at least one angle support includes a plurality of hinges.

13. The cover of claim 9, including at least one angle support attached to a back side of one of the first strip and second strip.

14. A cover comprising:

a first and a second strip of a rigid material connected by a first joint;

the first strip having a T-section member linked by a second joint to its long edge, the T-section member configured to attach to a C-shaped channel section attached to one of a door frame and a door;

the second strip having a support member linked by a third joint to its long edge and a fastening member, the support member configured to attach to one of a door frame and a door; and the fastening member configured to receive and engage a third rigid strip of material in parallel with the first strip along a length thereof.

15. The cover of claim 14, wherein the fastening member includes a projection extending along a surface of the second strip forming a cavity between the projection and the surface second strip.

16. The cover of claim 15, wherein the projection and cavity of the fastening member engage the third rigid strip of material to form a long cover.

* * * * *